United States Patent [19]

Campbell et al.

[11] Patent Number: 5,054,727

[45] Date of Patent: Oct. 8, 1991

[54] RAPID RACKER

[75] Inventors: John W. Campbell, Montgomery, Ala.; Welbourne D. McGahee, Melbourne, Fla.

[73] Assignee: Rapid Racker Systems, Montgomery, Ala.

[21] Appl. No.: 385,157

[22] Filed: Jul. 26, 1989

[51] Int. Cl.[5] ..... A47B 96/06

[52] U.S. Cl. ..... 248/220.3; 206/606; 211/59.1

[58] Field of Search ..... 248/220.3, 220.4; 211/59.1, 57.1; 206/806, 602, 606, 526; 229/9, 44 R

[56] References Cited

U.S. PATENT DOCUMENTS

| | | | |
|---|---|---|---|
| 296,484 | 4/1884 | Tate | 211/59.1 X |
| 781,313 | 1/1905 | Thomas | 211/59.1 X |
| 1,909,429 | 5/1933 | Sherman | 211/59.1 X |
| 1,914,710 | 6/1933 | Bronander | 206/526 |
| 2,905,339 | 9/1959 | Orchard | 211/59.1 X |
| 2,967,611 | 1/1961 | Bolinger | 206/57 |
| 3,148,770 | 9/1964 | Cosman | 206/57 |
| 3,211,293 | 10/1965 | Tarnoff | 211/59 |
| 3,313,407 | 4/1967 | Palm, Jr. | 206/65 |
| 3,473,756 | 10/1969 | Jones | 211/59.1 X |
| 3,529,716 | 9/1970 | O'Connell | 211/59.1 X |
| 3,638,801 | 2/1972 | Larson | 211/59.1 X |
| 3,730,738 | 5/1973 | Cook | 206/806 X |
| 3,952,872 | 4/1976 | Consiglio, Jr. | |
| 4,072,232 | 2/1978 | Marsman et al. | |
| 4,111,297 | 9/1948 | Paulin | 206/606 X |
| 4,301,575 | 11/1981 | Goldberg | 24/1 |
| 4,516,676 | 5/1985 | Cournoyer | 206/226 |

FOREIGN PATENT DOCUMENTS

| | | | |
|---|---|---|---|
| 1052341 | 4/1979 | Canada | 229/19 |

*Primary Examiner*—J. Franklin Foss
*Attorney, Agent, or Firm*—Harold Gell

[57] ABSTRACT

A shipping, storage and racking method and apparatus for packages designed to be hung on pegs on display racks includes a storage/transfer member dimensioned to pass through the openings by which the packages are hung. An opening is provided along the longitudinal axis of the storage/transfer member to permit the member to be slid over a display rack peg so that packages on the peg can be supported by the member and removed as a single unit by holding them on the member as it is slid off the peg. A reverse procedure is used to deposit packages carried on a storage/transfer member onto a peg. Packages are stored and transported by supporting a storage/transfer member loaded with packages within a container by special means which position and secure the member so that the packages are hung within the container without resting on the container bottom.

25 Claims, 3 Drawing Sheets

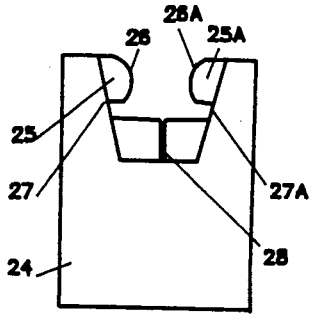
Fig. 13
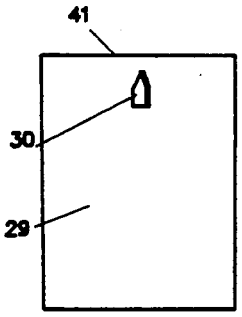
Fig. 14
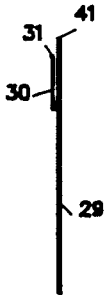
Fig. 14A
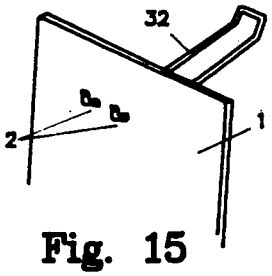
Fig. 15
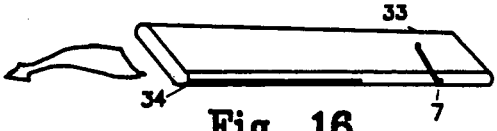
Fig. 16
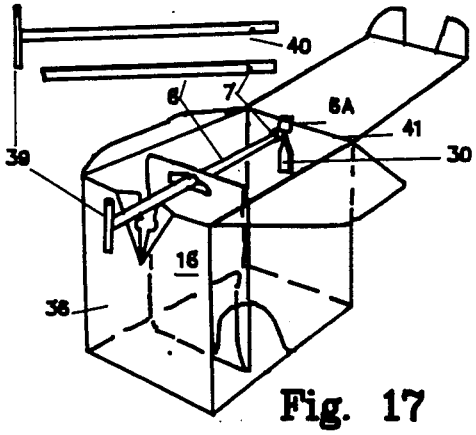
Fig. 17
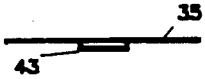
Fig. 18
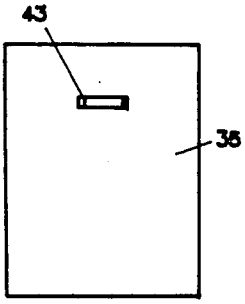
Fig. 18A
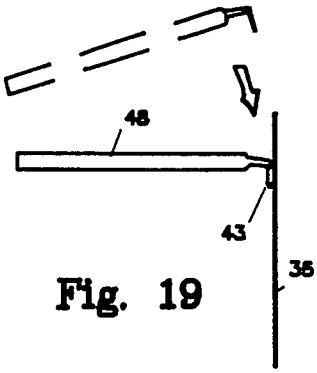
Fig. 19
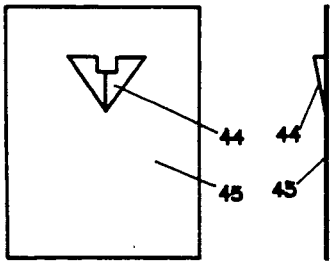
Fig. 20
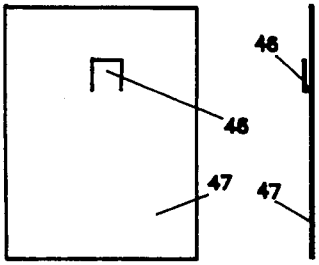
Fig. 20A
Fig. 21
Fig. 21A

RAPID RACKER

FIELD OF THE INVENTION

This invention relates to a method and apparatus for packing packages for shipment and storage that includes a means for rapid transfer from the containers to retail display pegboards or similar racks.

BACKGROUND OF THE INVENTION

A major cost factor in merchandising products is packing prepackaged items for shipment and storage and their retail display. The most successful form of retail display is achieved by prepacking items in blister display packages designed to be hung from racks of rod-like projections which extend from display walls or shelves. In many instances pegboards form the support for the projections to allow maximum versatility of space. Another popular display system is the freestanding display with a rotating central support structure.

These popular forms of retail displays have three major drawbacks. (1) The blister packages become distorted or broken due to crushing by other packages in a shipping or storage container. (2) Placing the packages on display racks is labor intensive. (3) Rearrangement of merchandise displays for sales promotion or other reasons is labor intensive.

A few attempts have been made to overcome the faults in prior merchandising systems. For instance R. Goldberg in U.S. Pat. No. 4,301,575 on "Packaging Clip" teaches the use of a spring clip to assist in unloading or loading a plurality of packages on a single peg of a rack. This is useful in moving items around on a rack but it fails to solve the shipping problem or the initial labor intensive chore of aligning packages on the clip or rack peg.

M. Tarnoff, U.S. Pat. No. 3,211,293 on "Rack Mountable Article Of Manufacture" is another attempt to overcome the faults in the display rack merchandising system. This system has the same basic shortcomings as the Goldberg system plus the retaining rubber band is left on the peg.

Specially constructed containers have been developed as an alternate means to solve some of the problems inherent in the display package merchandizing systems. Examples of such systems may found in U.S. Pat. Nos. 2,967,611 for "Carton for Merchandising Display Cards" issued to G. Bolinger; U.S. Pat. No. 3,148,770 for "Carton for Packaged Articles" issued to C. Cosman; U.S. Pat. No. 3,313,407 for "Carton for Storing and Loading Merchandise Cards" issued to F. Palm, Jr.; U.S. Pat. No. 3,952,872 for "Package Carded Merchandise" issued to P. Consiglio; U.S. Pat. No. 4,072,232 "Package for Multiple Containers" issued to J. Marsman et al; and Canadian Patent Number 1,052,341 for "Cartridge" issued to A. Paulin. The container approaches have many advantages but they fail to prevent package distortion and allow gravity induced crushing which can result in permanent disfigurement of the product display.

All of the prior attempts have failed to solve the problems inherent in existing blister packaging, i.e. the shipping/storage containers presently in use allow stored packages to slide down inside the shipping package and become bent because of gravitational forces. Because of the heat that is often present during the shipping and storage periods, the bent packages become permanently distorted. When the retailer is ready to display them they are unsightly.

OBJECTIVES OF THE INVENTION

A primary objective of this invention is to overcome the foregoing deficiencies and other faults in the prior display-pack rack merchandising systems.

Another objective of the present invention is to prove provide a protective magazine for packages designed to be hung and displayed on retail pegboards or similar racks using single or double pegs.

A further object of the present invention is to protect the stored packages and prevent them from being distorted.

Another objective of the present invention is to provide a rapid racking transfer means to save time in filling or restocking display racks.

Another objective is to provide a means for a manufacturer of packaged display goods to pack packages using the present invention's technique for rapid transfer for inserting the packages into the protective shipping/storage magazines.

Other objectives and advantages of the invention will become apparent from the detailed description of the invention taken in conjunction with the accompanying drawings.

SUMMARY OF THE INVENTION

This invention is directed to a method and apparatus for packing, storing and racking or shelving blister pack or similar merchandising display containers which are hung from display racks via holes in the containers or loops attached to the top of the containers.

The apparatus is comprised of an elongated channeled or tubular storage/transfer member dimensioned to fit over the pegs of the rack used for display purposes as well as the gathering tool of the packaging system. The outer dimensions of the elongated storage/transfer member are controlled so that packages may be hung on the member by the same hole or loop used to suspend the packages from the pegs of the display rack. A box or similar container is adapted to hold both ends of the storage/transfer member so that all items on the member are suspended within the confines of the box and may be removed with the storage/transfer member as a single unit by raising the storage/transfer member from the top of the box. A reverse process is used to place the storage member and suspended packages in the box.

The method of system operation includes the steps of collecting packages onto a gathering tool during the final stages of the package assembly process. Next the gathered packages are slid onto a storage/transfer member. The loaded storage/transfer member is lowered into the receptors in a box or magazine and the top is secured. At the retail outlet, the box top is opened or removed, the channel or hole through the length of the storage/transfer member is slid over the desired display peg, the packages and storage/transfer member are removed from the box as a single unit by lowering the box, and the storage/transfer member is pulled off the peg while the packages are held stationary so they drop onto the peg as the storage/transfer member is removed.

Packages are relocated or placed in storage by sliding a storage/transfer member through the hanging openings of the packages as it is slid over the peg. The packages are held on the storage/transfer member by raising a box or magazine to enclose the packages in reverse of the procedure used to place the items on a peg. The box, storage/transfer member and packages are then slid off the peg as a single unit. The packages, storage/transfer member and magazine are then placed in a box as a single, unit (loaded magazine) for storage or shipment. Alternately the packages may be deposited on another peg as previously described.

BRIEF DESCRIPTION OF THE DRAWINGS

FIG. 13 illustrates the front panel of a rapid racker magazine of the type used on double peg racks.

FIG. 14 illustrates the rear panel of a magazine showing the rear die cut support for the storage/transfer member.

FIG. 14A is an edge view of the rear panel seen in FIG. 14 showing a die cut section ready to receive the storage/transfer member of FIG. 10.

FIG. 15 illustrates a double peg of the type used with the magazines illustrated in FIGS. 1B, 10, 11, 13, 14 and 16.

FIG. 16 illustrates a flat storage/transfer member to be used on double arm pegs as illustrated in FIGS 1B, 15.

FIG. 17 illustrates a storage/shipping magazine showing the stored packages in place in the magazine.

FIG. 18 is a top view of the rear panel of FIG. 18A.

FIG. 18A is end view of FIG. 18.

FIG. 19 is a side view of the rear panel at FIG. 18A with a storage/transfer member of the type seen in FIG. 12A.

FIG. 20 is an end view of rear panel which uses a flattened and bent storage/transfer member.

FIG. 20A is an edge view of the rear panel shown in FIG. 20 illustrating the die cut rear support means FIG. 21 illustrates a rear support panel with a die cut support means.

FIG. 21A is an edge view of a rear panel die cut support means.

DETAILED DESCRIPTION OF THE INVENTION

Figure 1:
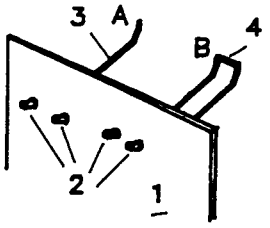
FIG. 1 illustrates a typical contemporary display rack and pegs.

FIG. 1 illustrates a conventional peg supporting structure 1 such as a pegboard or the like, having a plurality of apertures 2. The pegs 3 and 4 fit into the apertures 2 of the pegboard and protrude from the pegboard in a manner which allows the packages 16 to be slid onto the pegs 3 and 4 for storage or retail display.

Figure 2:
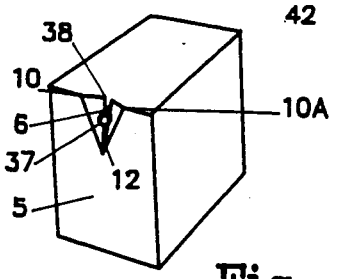
FIG. 2 illustrates a closed rapid racker transfer magazine of the single peg type as it is removed from its master shipping container.

FIG. 2 illustrates a closed rapid racker storage/ shipping magazine or box. A storage/transfer member arm 6 extends from the front panel 5. The storage/transfer member arm 6 is seated in die cut areas 12 and rear die cut area 8, see FIG. 7B. This keeps the packages 16 from touching the bottom of the magazine or bending due to the gravitational forces which would act on them if they were touching the bottom, see FIG. 17.

Figure 4:
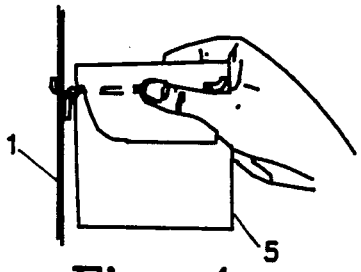
FIG. 4 illustrates the rapid racker with the storage/-transfer member over the rack peg.
Figure 5:
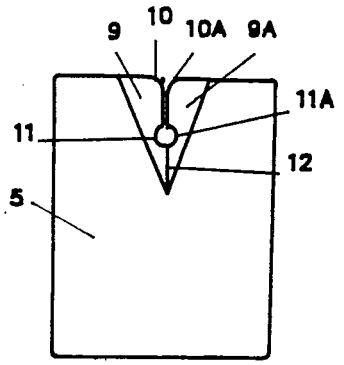
FIG. 5 illustrates the front panel of a rapid racker magazine of the single peg design with a die cut front section for rapid insertion and removal of packages.

In FIG. 2, 42 is the top of the magazine and 9 and 9A of FIG. 5 are curved die cut areas forming slot 12 which allows the storage/transfer member arm 6 to pass freely and rapidly into and out of the box or magazine with packages 16. The area 38 at the top 42 of the magazine secures the rapid racker storage/transfer member arm 6 and prevents upper movement during shipping and storage. The die cut center 12, between the left and right die cut areas 9 and 9A, includes the notch in which the rapid rack storage/transfer member arm 6 rests. The arm 6 includes a hole 37 which transverses the rack peg 3 seen in FIGS. 1, 3 and 4. Hole 37 is best seen in FIG. 4.

Figure 3:
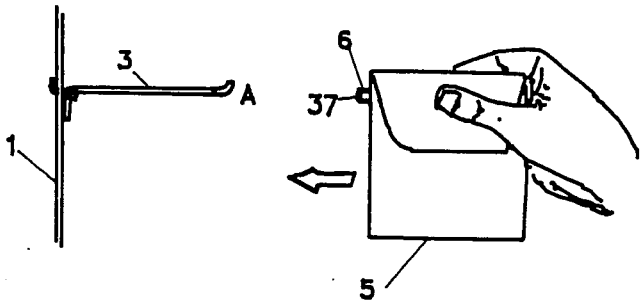
FIG. 3 illustrates the rapid racker transfer magazine approaching a display peg.
Figure 4A:
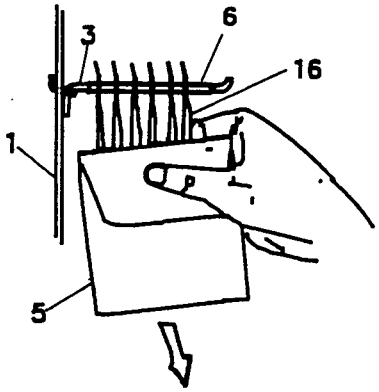
FIG. 4A illustrates a rapid racker magazine moving down and away from a rack peg.
Figure 4B:
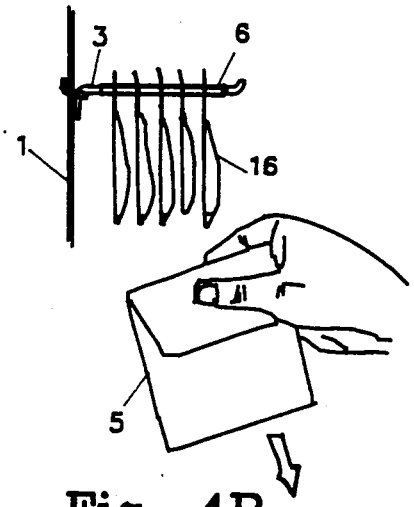
FIG. 4B illustrates the rapid racker magazine clear of the packages which are now racked on a rack peg with the storage/transfer member.
Figure 4C:
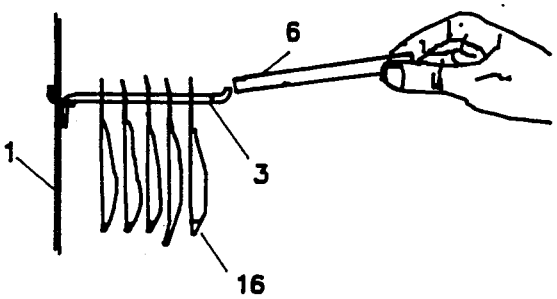
FIG. 4C illustrates the storage/transfer member removed from the rack peg.

In FIG. 3, the open end 37 of the storage/transfer member is shown approaching a display peg 3. In FIG. 4, the rapid storage/transfer member 6 has encompassed all of rack peg 3 and the entire magazine 5 surrounds the peg. The rapid transfer magazine 5 is removed from the rack peg 3 as seen in FIGS. 4A, 4B and 4C to complete the transfer.

After the storage/transfer member 6 is slid over a peg 3, slight downward pressure on the magazine 5 will free it from the rack. When downward pressure is applied to the magazine 5, the curved areas 11 and 11A of FIG. 5 allow the top curved area of the storage/transfer member 6 to clear the front support area of the storage/shipping magazine.

The curved areas 10 and 10A of FIG. 5 allow easy and rapid filling of the rapid racker magazine with the desired number of packages. The notch between areas 11 and 11A support the stored packages against damages due to gravitational forces by keeping the bottom edges of the packages from touching the bottom of the magazine; thus keeping the packages suspended in mid-air during their trip to the store display racks.

Figure 6:
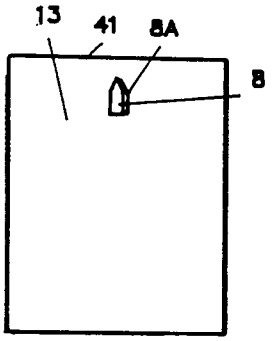
FIG. 6 illustrates the rear panel of a single peg rapid racker magazine showing the rear die cut support means for the storage/transfer member.
Figure 6A:
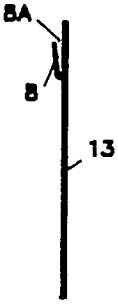
FIG. 6A is a side view of FIG. 6.
Figure 7:
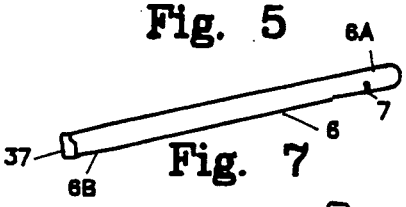
FIG. 7 illustrates a rapid racker storage/transfer member before the end is bent up 90 degrees.
Figure 7A:
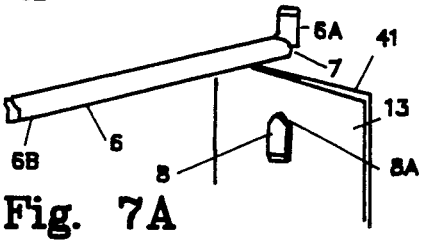
FIG. 7A illustrates the rapid racker storage/transfer member bent up 90 degrees in position to engage the rear die cut out section on the rear panel of the magazine.
Figure 7B:
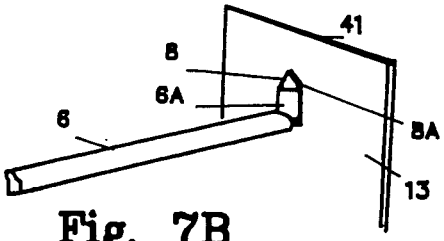
FIG. 7B illustrates the rapid racker storage/transfer member engaged in the rear support die cut panel.

The die cut area 8 in the rear panel 13 of the magazine illustrated in FIG. 6 supports the rear portion of the storage/transfer member. The die cut section 8 also retains the storage/transfer member 6 against accidental removal from the magazine during shipping and storage. In FIGS. 7, 7A and 7B, the slot 7 at 6A of the storage/transfer member is impaled on die cut area 8, thereby retaining the storage/transfer member 6 rigidly in place. The top edge of 6A is turned up 90 degrees to contact the inside area of the top of the magazine; thereby securing it against upwards movement.

The front end of the storage/transfer member 6 is retained by both curved cut-out areas 11 and 11A and the top edge area 38 of the lid as illustrated in FIG. 2. In FIG. 17 the areas that would touch the top of lid 42 at 38 are further identified as 26 and 26A. These safety sections retain the storage/transfer member 6 in place in the magazine.

Figure 12G:
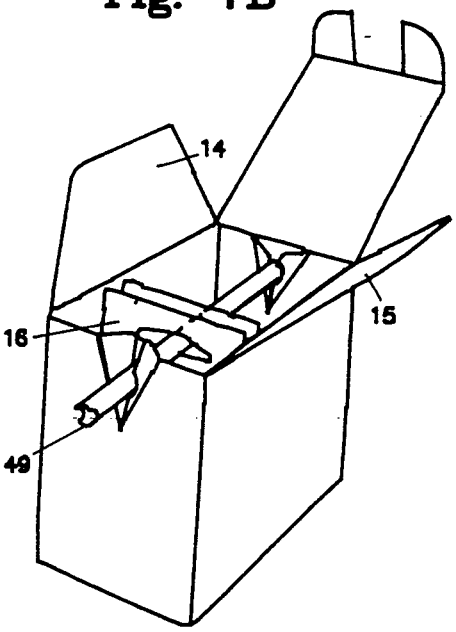
FIG. 12G illustrates an open rapid racker magazine with a storage/transfer member of the type seen in FIG. 12B.
Figure 12:
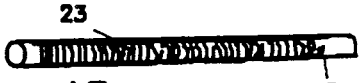
FIG. 12 illustrates a storage/transfer member made of accordion material which will allow the storage/-transfer member to transverse over pegs which have multiple bends in them

FIG. 13 illustrates a magazine designed for a double peg rack. The wider, flat storage/transfer member on arm 33 of FIG. 16 has a split 34 in it to allow the storage/transfer member to pass over the wider double peg racks. In this embodiment, all of the procedures are the same. On display racks that have more than one bend in the pegs, the storage/ transfer member is as illustrated in FIG. 12. This accordion configuration allows the storage/transfer member 23 to freely pass over the bends.

Figure 8:
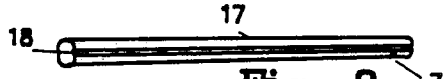
FIG. 8 illustrates a storage/transfer member of the sliced or split type.

FIG. 8 illustrates a split storage/transfer member 17 with the split 18 extending the length of the arm 17.

Figure 8A:
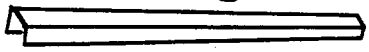
FIG. 8A illustrates a storage/transfer member having an inverted "U" channel configuration.

FIG. 8A illustrates a storage/transfer member with a "U" channel extending the length of the arm.

Figure 9:
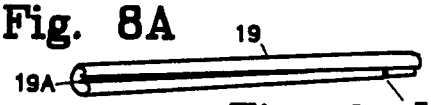
FIG. 9 illustrates an overlapping expanding storage/-transfer member.
Figure 11:
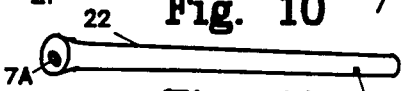
FIG. 11 illustrates a combination storage/transfer member which can be used on either single rod type racks or on double rod racks. Note each end has a slice to fit into the die cut rear support of either shipping magazine seen in FIGS. 7B or FIG. 17.

FIG. 9 illustrates an overlap 19A which allows storage/ transfer member 19 to expand and contract. A flat split storage/transfer member 20 is illustrated in FIG. 16. The split 21 in storage/transfer member 20 extends only to the cut 7 along which the end of the storage/-transfer member is bent up 90 degrees. FIG. 11 illustrates a double ended storage/ transfer member 22 which has a slotted area 7 at one end and a notched area 7A in the flared end. The end of storage/transfer member 22 is flared at 7A to allow the flared end to transfer packages onto double peg racks. The storage/transfer members 48 in FIG. 12, 49 in FIG. 12B and FIG. 12G, 50 in FIG. 12C, 51 in FIG. 12D, 52 in FIG. 12E, 53 in FIG. 12F, all serve the same function as the storage/-transfer member 6. They are examples different ways in which they can be made to fill different needs for racks other than the single peg racks and the double peg racks.

Rear panels 13 and 29 are the same except the die cut area 30 of rear panel 29 in FIG. 14 is wider to accommodate wide storage/transfer support members such as 33 of FIG. 16. The split area 12 in FIG. 2 and FIG. 5 are the same as the split area 28 in front panel 24 in FIG. 13. The only difference is that front panel 24 is used with the wider storage/transfer member 33 to fit over double pegs 32 of the type illustrated in FIG. 15.

In FIG. 13, die cut curves 26 and 26A serve the same function as the die cut curves 10 and 10A of FIG. 5 and flaps 25 and 25A serve the same function as 9 and 9A in that both 9, 9A and 25, 25A allow a free and rapid removal of the storage/transfer member with packages 16 on the arms 33 or 6. The die cut portions 27 and 27A of the front flaps of FIG. 13 corresponds to 11, 11A of FIG. 5.

In FIG. 14, an open space 31 is created when rear support 30 is bent in for use. The open space corresponds to the die cut rear support space 8A of FIG. 6.

The panels in FIG. 5 and FIG. 6 are preferred alternate embodiments. Other panels in FIGS. 13, 14, 18, 18A, 19, 20, 20A, 21 and 21A illustrate alternate embodiments for the front and rear panels of the magazine that can be made without departing from the function of the rapid racker system.

In FIG. 5, the curved areas at 10 and 10A allows for easy loading of the packages 16 into a rapid racker magazine such as illustrated in FIG. 17. The curved shape of the storage/transfer member (arms 6, 17, 19, 22, 23, 48, 49, 50, 51, 52 and 53) where they meet 10 and 10A of the front panel of the magazine forms a guide path for the storage/transfer members loaded with packages 16.

When the packages 16 are ready to be unloaded onto the rack peg 3, the curved angles of 11 and 11A allow the storage/transfer member arm's curved surface to guide the loaded arm 16 out of the supporting means. The hole 37 in the storage/transfer member arm 6 allows the arm to pass over peg 3, see FIG. 4. At this point the rapid racker magazine is pulled slightly downward and towards the operator in order to transfer the packages 16 onto rack peg 3. FIGS. 4A and 4B best illustrate this transfer step.

When the storage/transfer member is of the type seen in FIG. 7B, the arm 6 has section 6A bent at 90 degrees to the rest of the arm and it is impaled on the die cut tab 8 of panel 13. This locks the storage/transfer member arm 6 in place and it remains impaled on the die cut tab 8. In this embodiment, the steps seen in FIG. 4C of removing the storage/transfer member 6 from peg 3 is eliminated and the transfer is complete when the magazine is removed. The different transfer arms illustrated work in the same manner.

The front panel 24 in FIG. 13 is used with a storage/-transfer member arm 33 of the type illustrated in FIG. 16. This wider transfer arm can be used for both single or double pegs 3, 4 or 32 as illustrated in FIGS. 1 and 15. The packing of packages 16 onto the storage/transfer member arm 33 is the same as with storage/transfer member arm 6 as previously described. The rear panel 29 in FIG. 14 has a die cut area 30 which is the same shape as die cut area 8 of FIG. 6. The only difference between die cut area 30 and die cut area 8 is that die cut area 30 is wider than die cut 8 in order to function with the storage/transfer member 33 of FIG. 16.

The rear panel 35 in FIGS. 18, 18A and 19 is used with storage/transfer member arm 48 which is placed on the die cut section support 43.

The rear panel 45 and die cut support 44 of FIG. 20 and FIG. 20A illustrates another design to support the storage/transfer member when a flat to square storage/-transfer member arm is used.

The rear panel 47 in FIGS. 21 and 21A is used with storage/transfer member 33 for packages needing more support.

The packing of packages 16 into the rapid racker is accomplished as follows. An end of the storage/transfer member arm 6 is slid into a stack of a desired number of packages. A rigid arm 39 may be used inside the storage/transfer member arm 6 in order to apply the needed pressure to cause the following actions to take place.

The rigid placement tool 39 is placed inside the storage/transfer member arm 6, the notched area 40 on tool 39 allows a slice 7 to be made in the arm 6. This sliced area 7 is designed to allow the transfer arm 6 to be bent up when it hits the edge of the magazine's rear panel at 41 in order to bend end 6A of the arm 6 up 90 degrees. In FIG. 17 the arm 6 has started its bend, illustrating the sliced area of arm 6 is being bent at 7.

Once end 6A has completed its 90 degree bend, area 7 is open at the bottom of the bend. At this moment the die cut tab 8 in the rear panel of the magazine is positioned to enter end 6A. FIG. 7B illustrates the mating of die cut tab 8 inside the bent end 6A of the arm, securing the arm against movements left, right, down, fore or aft relative to the front of the magazine. When the lid is in a closed position, the end of section 6A touches the inside of the top of the box 42. The storage/transfer member arm end 6A cannot be moved upwards, thereby securing the support arm from movement in any direction.

Although a preferred embodiment of the invention has been disclosed in detail to enable one skilled in the art to make and use this invention, it will now be understood in view of the applicants' teaching herein, that variation in material, dimensions and geometry are contemplated as being within the scope of the present invention, which is limited only by the appended claims.

What we claim is:

1. A racker for a package support of the type which includes peg means for supporting items including an opening dimensioned to permit said peg to pass therethrough whereby said items are hung from said peg, comprising:

a transfer member including a section dimensioned to pass through said opening in said items, said section including a peg receiving opening; and means for supporting said transfer member including front and rear means for retaining said items on said section.

2. An apparatus as defined in claim 1, wherein said means for supporting said transfer member comprises a container for said items.

3. An apparatus as defined in claim 1, wherein said means for supporting said transfer member comprises a container dimensioned to hold said items suspended from said transfer member without engaging the outer edges of said items.

4. An apparatus as defined in claim 1, wherein an end of said section includes a means for allowing deformation in response to engagement with one of said means for retaining said items on said section for creating a means for holding said end adjacent to said means for retaining said items.

5. An apparatus as defined in claim 2, wherein one of said means for retaining said items on said section includes an opening dimensioned to allow passage of one of said pegs into said peg receiving opening in said section.

6. An apparatus as defined in claim 1, wherein said peg receiving opening is a bore.

7. An apparatus as defined in claim 1, wherein said peg receiving opening is an inverted "U" shaped channel.

8. An apparatus as defined in claim 1, wherein said section is a tube.

9. An apparatus as defined in claim 1, wherein said section is a box beam.

10. An apparatus as defined in claim 1, wherein one of said means for retaining said items on said section includes an opening dimensioned to conform to the outer periphery of a cross-section of said section and a slot bifurcating said opening, said slot extending from said opening through the top of said means for retaining said items on said section.

11. An apparatus as defined in claim 1, wherein an end of said section includes a means for allowing deformation in response to engagement with said rear means for retaining said items on said section for creating a means for holding said end adjacent to said rear means for retaining said items; and said front means for retaining said items on said section includes an opening dimensioned to conform to the outer periphery of a cross-section of said section and a slot bifurcating said opening, said slot extending from said opening through the top of said front means for retaining said items on said section.

12. A system as defined in claim 1 wherein said transfer member is shaped and relatively dimensioned as illustrated in FIG. 8.

13. A system as defined in claim 1 wherein said transfer member is shaped and relatively dimensioned as illustrated in FIG. 9.

Figure 10:
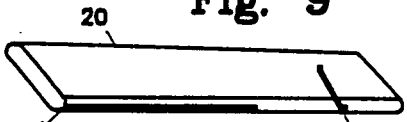
FIG. 10 illustrates a split flattened storage/transfer member used with double or wide peg racks as seen in FIG. 15.

14. A system as defined in claim 1 wherein said transfer member is shaped and relatively dimensioned as illustrated in FIG. 10.

15. A system as defined in claim 1 wherein said transfer member is shaped and relatively dimensioned as illustrated in FIG. 11.

16. A system as defined in claim 1 wherein said transfer member is shaped and relatively dimensioned as illustrated in FIG. 12.

Figure 12A:
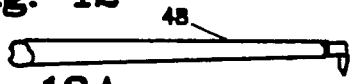
FIG. 12A illustrates a storage/transfer member notched on one end and flattened and bent 90 degrees at the other end.

17. A system as defined in claim 1 wherein said transfer member is shaped and relatively dimensioned as illustrated in FIG. 12A

Figure 12B:
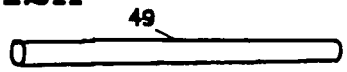
FIG. 12B illustrates the straight storage/transfer member used in FIG. 12G.

18. A system as defined in claim 1 wherein said transfer member is shaped and relatively dimensioned as illustrated in FIG. 12B.

Figure 12C:
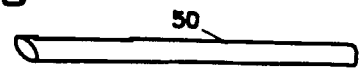
FIG. 12C illustrates a storage/transfer member with one end partly flattened.

19. A system as defined in claim 1 wherein said transfer member is shaped and relatively dimensioned as illustrated in FIG. 12C.

Figure 12D:
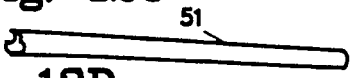
FIG. 12D illustrates a storage/transfer member with one end notched as in FIGS. 7, 7A, 7B, 12A, 12D, 12E and 12F. This notched end allows for rapid alignment of the notched end when used with double peg racks.

20. A system as defined in claim 1 wherein said transfer member is shaped and relatively dimensioned as illustrated in FIG. 12D.

Figure 12E:
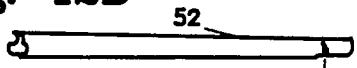

21. A system as defined in claim 1 wherein said transfer member is shaped and relatively dimensioned as illustrated in FIG. 12E.

Figure 12F:
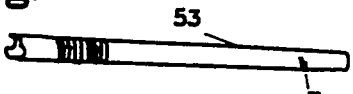

22. A system as defined in claim 1 wherein said transfer member is shaped and relatively dimensioned as illustrated in FIG. 12F.

23. A system as defined in claim 1 wherein said transfer member is shaped and relatively dimensioned as illustrated in FIG. 8A.

24. An apparatus as defined in claim 1, further comprising a rigid support tool for supporting said transfer member during package loading operations.

25. A racker for a package support of the type which includes peg means for supporting items including an opening dimensioned to permit said peg to pass therethrough whereby said items are hung from said peg, comprising:

a transfer member including a section dimensioned to pass through said opening in said items, said section including a peg receiving opening; and means for supporting said transfer member including front and rear means for retaining said items on said section;

a container for said items;

a top for said container;

an end of said section including means for allowing deformation in response to engagement with said rear means for retaining said items on said section for creating a means for holding said end adjacent to said rear means for retaining said items;

said front means for retaining said items on said section includes an opening dimensioned to conform to the outer periphery of a cross-section of said section and a slot bifurcating said opening, said slot extending from said opening through the top of said front means for retaining said items on said section;

a tab means on the inside of said rear means for retaining said items on said section; said tab dimensioned to pass within said peg receiving opening of said section;

said means for allowing deformation including a slit perpendicular to the longitudinal axis of said section for controlling the deformation point of said end of said section and providing an opening for receiving said tab; and said deformed end of said section dimensioned to encompass said tab and concurrently engage the cover of said container when said cover is in a closed position.

* * * * *

UNITED STATES PATENT AND TRADEMARK OFFICE

CERTIFICATE OF CORRECTION

PATENT NO. : 5,054,727

DATED : October 8, 1991

INVENTOR(S) : John W. Campbell, et al.

It is certified that error appears in the above-identified patent and that said Letters Patent is hereby corrected as shown below:

Title page: Item (75) inventors, James H. Muir was omitted, please add.

Signed and Sealed this

Eleventh Day of February, 1992

*Attest:*

HARRY F. MANBECK, JR.

*Attesting Officer*

*Commissioner of Patents and Trademarks*